US010829924B2

(12) United States Patent
McGurn et al.

(10) Patent No.: US 10,829,924 B2
(45) Date of Patent: Nov. 10, 2020

(54) COMPOSITE WALL AND METHODS OF CONSTRUCTING A COMPOSITE WALL

(71) Applicant: ADVANTAGE WALL LLC, Richmond, VA (US)

(72) Inventors: Arthur S. McGurn, Richmond, VA (US); Victor P. Morrissette, Richmond, VA (US); Lee Morrissette, Powhatan, VA (US); Patrick Cody Morrissette, Midlothian, VA (US)

(73) Assignee: ADVANTAGE WALL LLC, Richmond, VA (US)

( * ) Notice: Subject to any disclaimer, the term of this patent is extended or adjusted under 35 U.S.C. 154(b) by 0 days.

(21) Appl. No.: 16/042,530

(22) Filed: Jul. 23, 2018

(65) Prior Publication Data

US 2020/0024840 A1 Jan. 23, 2020

(51) Int. Cl.

| | |
|---|---|
| ***E04C 1/00*** | (2006.01) |
| ***E04B 1/04*** | (2006.01) |
| ***E04B 1/14*** | (2006.01) |
| ***E04B 1/70*** | (2006.01) |
| ***E04B 1/80*** | (2006.01) |
| ***E04B 1/76*** | (2006.01) |
| *E04B 1/24* | (2006.01) |
| *E04B 1/00* | (2006.01) |

(52) U.S. Cl.

CPC ..... *E04B 1/04* (2013.01); *E04B 1/14* (2013.01); *E04B 1/7038* (2013.01); *E04B 1/7608* (2013.01); *E04B 1/806* (2013.01); *E04B 1/0007* (2013.01); *E04B 2001/2481* (2013.01)

(58) Field of Classification Search

None

See application file for complete search history.

(56) References Cited

U.S. PATENT DOCUMENTS 3,000,144 A * 9/1961 Kitson ..... E04C 2/205 52/309.11
3,812,635 A * 5/1974 Hala ..... E04B 1/4185 52/747.12
4,052,831 A * 10/1977 Roberts ..... E04F 13/0844 52/309.8
4,672,787 A * 6/1987 Murphy ..... E04B 1/642 52/409
4,997,602 A * 3/1991 Trimble ..... E02D 29/12 249/10

(Continued)

*Primary Examiner* — Basil S Katcheves

(74) *Attorney, Agent, or Firm* — Bernard G. Pike; Pike IP Law, PLLC

(57) ABSTRACT

Composite walls have the structural components connected to form a substantially unitary structure. A composite wall is described that includes a block and/or brick wythe adhered to a poured concrete wall. The composite wall may also have a panel sheet material adhered to the poured concrete opposite surface of the poured concrete wall. Further, the composite wall may include a first wythe comprising concrete blocks, bricks, or a combination thereof, a poured concrete core, and a rigid insulation panel, wherein at least a portion of the blocks and/or bricks of the first wythe are adhered to a first surface of the concrete core and the rigid insulation panel is adhered to a second surface of the poured concrete core. Wire ties may extend from the mortar joints in the first wythe through the rigid insulation panel.

22 Claims, 7 Drawing Sheets

(56) References Cited

U.S. PATENT DOCUMENTS

| | | | | |
|---|---|---|---|---|
| 5,032,197 | A * | 7/1991 | Trimble | E02D 29/12 156/308.4 |
| 7,681,368 | B1 * | 3/2010 | Rubio | E04C 2/044 256/31 |
| 2006/0168906 | A1 * | 8/2006 | Tonyan | B32B 3/06 52/264 |
| 2006/0201090 | A1 * | 9/2006 | Guevara | C04B 16/08 52/309.12 |
| 2006/0242921 | A1 * | 11/2006 | Massie | E04B 1/4185 52/309.4 |
| 2007/0294974 | A1 * | 12/2007 | Tonyan | B28B 5/027 52/481.1 |
| 2010/0058700 | A1 * | 3/2010 | LeBlang | E04B 1/165 52/506.05 |
| 2011/0138702 | A1 * | 6/2011 | Kelley | E04B 2/8647 52/79.9 |
| 2011/0146195 | A1 * | 6/2011 | Hohmann, Jr. | E04B 1/4178 52/713 |
| 2011/0173902 | A1 * | 7/2011 | Hohmann, Jr. | E04B 1/4178 52/167.1 |
| 2015/0121792 | A1 * | 5/2015 | Spoo | E04B 1/4178 52/483.1 |
| 2015/0184383 | A1 * | 7/2015 | Foderberg | E04C 2/049 52/405.1 |

* cited by examiner

COMPOSITE WALL AND METHODS OF CONSTRUCTING A COMPOSITE WALL

FIELD OF THE INVENTION

Composite walls have the structural components connected to form a substantially unitary structure. Embodiments of the composite walls comprise a block and/or brick wythe adhered to a poured concrete wall. The composite wall may also comprise a panel sheet material adhered to the poured concrete opposite surface of the poured concrete wall.

More specifically, embodiments may include a composite foundation wall comprising a first wythe comprising concrete blocks, bricks, or a combination thereof, a poured concrete wall, and a rigid insulation panel, wherein at least a portion of the blocks and/or bricks of the first wythe are adhered to a first surface of the concrete core and the rigid insulation panel is adhered to a second surface of the poured concrete core.

BACKGROUND

A foundation or crawl space comprises a footer and a foundation wall. The footing and foundation wall transfers the load of a structure to the earth to prevent subsidence and resists loads imposed by the shifting earth and water. A foundation for residential construction may comprise footings, walls, slabs, piers, piles, or a combination of these components.

The most common residential foundation materials are concrete masonry (i.e., concrete block, bricks) and cast-in-place concrete. Preservative-treated wood, precast concrete, and other methods may also be used. Common foundation types include concrete slab, basements, and crawlspaces.

A crawlspace is a building foundation that uses a perimeter foundation wall to create an under-floor space that is not habitable. The interior crawlspace ground elevation may or may not be below the exterior finish grade. A basement is typically defined as a portion of a building that is partly or completely below the exterior grade and that may be used as habitable or storage space. A stem wall or a foundation wall (hereinafter "foundation walls") supports the building loads and, in turn, is supported directly by the soil or a footing.

Concrete is a major component of footings and foundation walls. Concrete is a mixture of cement, water, aggregate such as sand, gravel, crushed rock, slag, for example. The quality and proportions of the components determine the concrete mix's compressive strength and durability.

Concrete masonry units (hereinafter, CMUs) are commonly referred to as concrete blocks. Standard concrete blocks are comprised of Portland cement, aggregate, water, and, optionally, admixtures that modify the properties and processability of the concrete. Low-slump concrete is molded and cured to produce strong blocks or CMUs. Residential foundation walls are typically constructed with 7⅝ inches high by 15⅝ inches long CMUs. After addition of ⅜-inch bed and head joints, the nominal size of a CMU is 8 inches by 16 inches.

In residential construction, nominal 8-inch-thick and nominal 4-inch thick CMUs are readily available. A common practice in residential basement foundation wall construction is to provide a brush- or spray-applied bituminous coating on the below-grade portions of the foundation wall. This treatment is usually required for basement walls of masonry, however, in concrete construction, the parge coating is not necessary.

Footings provide a level surface for construction of the foundation wall; provide adequate transfer and distribution of building loads to the underlying soil; provide adequate strength, in addition to the foundation wall, to prevent differential settlement of the building in weak or uncertain soil conditions; place the building foundation at a sufficient depth to below a frost line; and provide adequate anchorage or mass to resist potential uplift and overturning forces resulting from high winds or severe seismic events.

Continuous concrete spread footings are typically constructed in residential construction. The footings may be constructed by pouring concrete into a trench dug below to a depth below the frost line.

There is a need for a composite foundation wall, composite retaining wall, a composite basement wall, or composite garage wall that comprises CMUs that produces a sealed crawlspace. There is also a need for a composite foundation wall that incorporates a poured concrete core. There is also a need for methods of constructing a composite foundation wall, a composite retaining wall, a composite basement wall, or composite garage wall.

SUMMARY

Embodiments of a composite wall structure comprising a concrete masonry units ("CMU") wythe comprising at least one course of a plurality of concrete masonry units, a concrete core adhered to an inner surface of the plurality of concrete masonry units, and a rigid panel adhered to an inner surface of the concrete core. In certain embodiments of the composite wall, the CMU wythe and the concrete core are tied together by wall ties. The wall ties may be embedded in a joint between the concrete masonry units and extending into the concrete core. The wall tie may be embedded in a bed joint or a head joint of the CMU wythe comprising a plurality of concrete masonry units. In further embodiments, the wall ties comprise a wire tie that extends into the rigid panel.

The composite wall structure may be constructed on a footing. The footing may be a concrete reinforced footing or an aggregate footing. The footing may be a trench footing or a formed footing.

The wythe will typically comprise a plurality of courses at least one course of a concrete masonry unit is a course of concrete block. The outer wythe may be any combination of exterior wall facings. In one embodiment, the wythe has at least one course of 4-inch concrete blocks and at least one course of bricks laid on top of the concrete blocks.

The composite wall structure comprises a concrete core that is adhered to an inner surface of the concrete masonry units. The concrete core is poured between the wythe of CMU and the rigid panel. The wet concrete fill gaps in the CMU wythe including, but not limited to, gaps in the bed and/or head joints and the texture of the CMU themselves. The texture of the CMU may be the result of the texture of a normal CMU formed by the manufacturing process or intentional texture formed in the CMU such as a brick or concrete block comprising grooves, indentions or protrusions intentionally formed in the CMU to enhance the adhesion between the concrete core and the CMU wythe. All or a portion of the CMUs may comprise the intentionally formed texture features.

The composite wall structure comprises a rigid panel. The rigid panel may be any sheet material. For example, in the production of a sealed crawl space, the rigid panel may be a insulation foam board. The rigid panel may have at least one groove to provide a texture feature for adherence to the concrete core.

The composite wall structure comprises a wall tie. The wall tie may perform various functions with manufacturing the composite wall and supporting or tying together the components of the wall. The wall tie comprises a CMU joint portion, a concrete core portion, and a wire tie portion. The CMU joint portion is installed in either a bed joint or a head joint in the CMU wythe. The concrete core portion extends through the concrete core into the rigid panel.

During construction of the composite wall the wire tie may extend through the rigid panel and also through a form that supports the rigid panel as the concrete core is poured.

Embodiments of a method for constructing a composite wall structure are disclosed. An embodiment of the method may comprise laying at least two courses of CMUs on a footing to create a CMU wythe. A wall tie may be placed at a mortar joint of the CMU wythe wherein a portion of the wall tie protrudes out of the mortar joint. The mortar joint may be a bed joint or a head joint.

The wall tie may comprise a tie wire. The wall tie may comprise a rod and the wire tie is rotatably attached to the tie wire.

Embodiments of the invention also include a method of constructing a composite foundation wall. Embodiments of the method comprise laying at least two courses of construction blocks and/or bricks to form a CMU wythe and embedding a joint reinforcement in a mortar joint, wherein the joint reinforcement comprises a wire tie. The method further comprises threading the wire tie though or attaching a wire tie to a rigid panel to form a cavity between the CMU wythe and the rigid panel. The method of further comprises pouring concrete into the cavity formed between the CMU wythe and the rigid panel.

The rigid panel may be supported by a wall form. In such an embodiment, the method comprises installing a wall form on the outer side of the rigid panel (the outer side of the rigid panel is the side opposite the cavity). The wire ties may be threaded through the wall form to support the wall form and the rigid form.

Another embodiment of the method of constructing a composite foundation wall comprises pouring concrete into a form comprising a wythe of construction blocks and/or bricks on one side of the cavity and a rigid panel on the other side of the cavity. The method comprises constructing the wythe of construction blocks and/or bricks. The method further comprises linking the wythe of construction blocks and/or bricks to the rigid panel to support the form during the pouring of the concrete. The rigid panel may further be supported by a wall form behind the rigid panel. The wall form may be linked to the wythe of construction blocks and/or bricks instead of the rigid panel to support the form.

Other aspects and features of embodiments of the composite foundation wall and the method of constructing a composite foundation wall will become apparent to those of ordinary skill in the art, upon reviewing the following description of specific, exemplary embodiments of the present invention in concert with the figures. While features may be discussed relative to certain embodiments and figures, all embodiments can include one or more of the features discussed herein. While one or more embodiments may be discussed herein as having certain advantageous features, each of such features may also be integrated into various other of the embodiments of the invention (except to the extent that such integration is incompatible with other features thereof) discussed herein. In similar fashion, while exemplary embodiments may be discussed below as system or method embodiments it is to be understood that such exemplary embodiments can be implemented in various systems and methods.

BRIEF DESCRIPTION OF THE DRAWINGS

FIGS. 2A, 28, 2C and 2D depict additional embodiments of a wall tie comprising a wire tie;

DESCRIPTION

Embodiments of the Composite Foundation Wall

Figure 1:
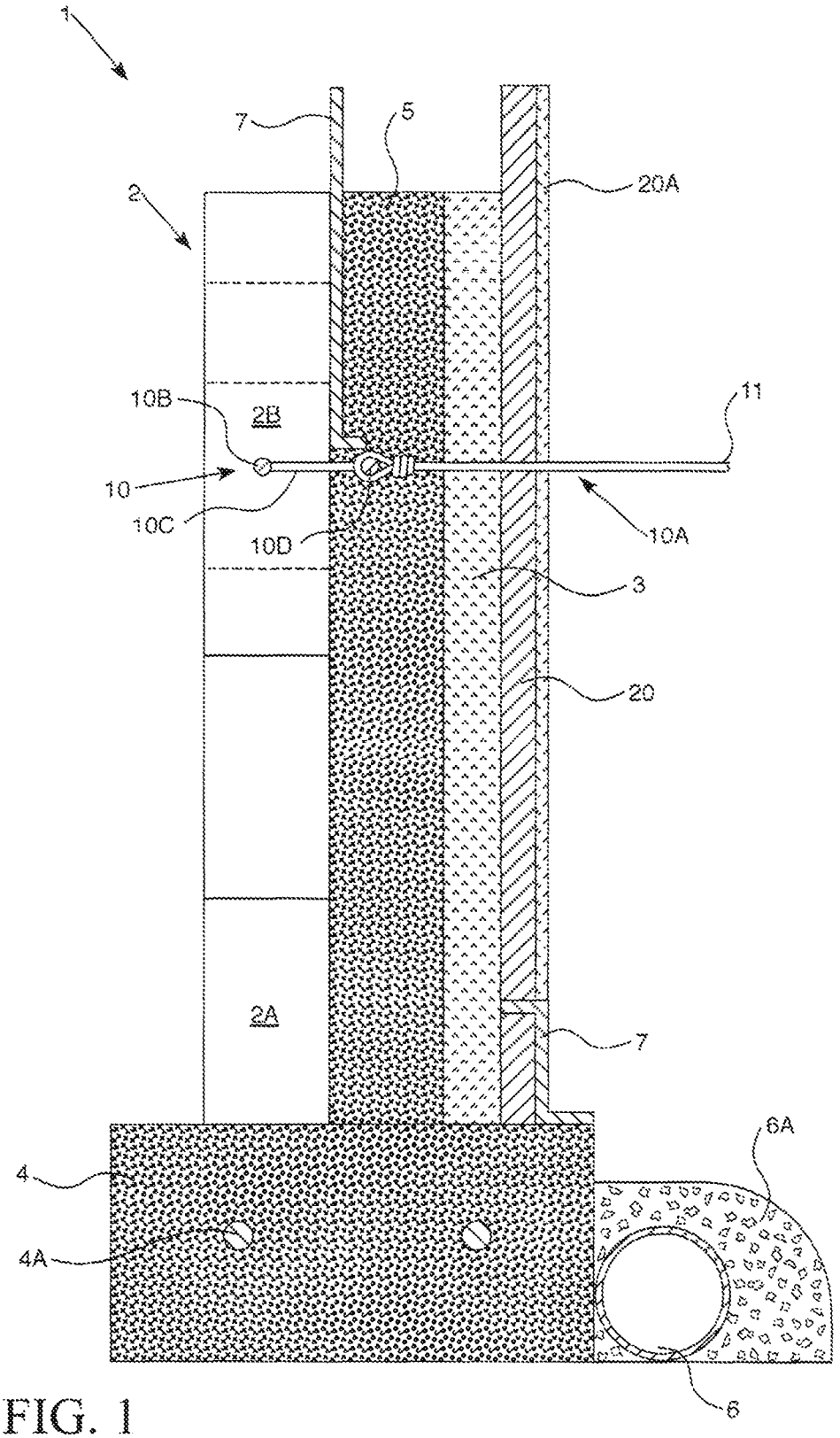
FIG. 1 depicts an embodiment of a composite foundation wall for defining a crawl space under a residential building, wherein the composite foundation wall comprises a CMU wythe, a concrete core, and a rigid foam insulation board.

Construction foundation walls are used in many residential and commercial buildings and structures such as, but not limited to, walls defining crawlspaces, garage walls, retaining walls, walls for signs, and free-standing walls, for example. An embodiment of a composite foundation wall 1 is shown in FIG. 1. The composite foundation wall 1 comprises a CMU wythe 2. In the embodiment of the composite foundation wall of FIG. 1, the CMU wythe is shown as a masonry wall comprising both construction block and bricks. In FIG. 1, there are two courses of construction block 2A (nominal 4 inch deep by 8-inch tall by 16-inch long, other size construction blocks may also be used.) and five courses of Engineered oversized brick or six courses of modular size brick 28. For example, an eight-inch deep construction block may be used on at least the first course. The eight-inch deep block may assist in positioning the rigid panel 3 during construction of the composite foundation wall, for example.

The CMU wythe 2 is laid on a footing 4. The footing may be a concrete footing reinforced with rebar 4*a* as shown in FIG. 1. The footing is designed to transfer the load of the building to the ground. The footing may be constructed as a formed footer or a trench footing as known in the art.

In the embodiment of the composite foundation wall 1 shown in FIG. 1, a concrete core 5. The concrete core 5 may provide strength and water impermeability to the composite foundation wall 1. The concrete core was produced by pouring concrete into a cavity defined by the CMU wythe 2, the rigid panel 3 and the top surface of the footing 4. In the embodiment shown in FIG. 1, the concrete is 4000 psi or better concrete. Other concrete mixtures may be used as applicable for the desired function of the composite foundation wall. The wet concrete as poured will flow into a texture features of the CMU wythe including texture features on the construction blocks and bricks and any gaps in either the bed or head joints. The concrete in these texture features will lock or otherwise adhere the concrete core to the CMU wythe.

On the opposite side of the concrete core, the embodiment of the composite concrete wall shown in FIG. 1 comprises a rigid panel 3. For a sealed crawl space wall, the inside surface of the wall is preferably insulated since the crawl-space is heated and cooled the same as the building. Air handling ducts will have vents that discharge air into the crawl space. In such embodiments as shown in FIG. 1, the rigid panel may be a rigid foam insulation panel. The rigid panel may be any rigid panel that provides the desired inner surface to the composite foundation wall 1 and provide the rigidity needed to support the concrete when poured into the concrete core cavity. The rigid panel may be foam insulation board, plywood, particle board, dry wall, or another rigid panel, for example. The rigid panel may also be a wall form used during the manufacturing process but removed after the concrete core is cured.

Embodiments of the rigid foam insulation board may be manufactured for use in the construction of the composite foundation wall. In such embodiments, the rigid foam board or other rigid panel may comprise a panel constructed of the desired material, for example, a rigid foam. To facilitate adherence of the panel to the concrete core and to assist in the placement of the wire ties through the panel, a back surface of the panel may have at least one groove defined in the rigid foam in the back surface. The grooves on the back surface of the rigid panel will correspond to the openings for the wire ties on the wall form which, in the embodiment of FIG. 1, correspond to the height of the mortar joints in the CMU wythe. Therefore, in one embodiment, the rigid foam insulation board or other rigid panel will comprise one of the at least one groove located between 7 inches and 9 inches from a bottom edge. In an embodiment, wherein the rigid panel rests on the footing and the composite wall uses 8-inch tall CMU blocks/brick, the first groove of the at least one groove is 8 inches from the bottom edge.

In such an embodiment, a second groove defined in the rigid foam may be located between 23 and 25 inches from the bottom surface on top of the third course of CMU. In an embodiment, wherein the rigid panel rests on the footing and the composite wall uses 8-inch tall CMU blocks/brick, the second groove of the at least one groove is 24 inches from the bottom edge. Of course, a second groove may be manufactured to align with the mortar joint of the second course if desired. The grooves may be manufactured to align with any of the bed joints and/or, if desired, any of the head joints. For composite walls with wall ties embedded in every other mortar joint in the 8-inch CMU, the grooves will be spaced approximately every sixteen inches.

Therefore, for a rigid foam insulation board comprising a third groove defined in the rigid foam, the third groove is between 39 and 41 inches from the bottom surface. The groove may be substantially parallel.

Embodiments of the composite foundation wall may also comprise an internal drainage system. The internal drainage system of embodiments of the composite foundation wall 1 may comprise a drainage pipe installed below the top of the footing. The drainage pipe 6 may be laid at the bottom of the excavation dug for a formed concrete footing, for example. The drainage pipe may be any perforated pipe that collects water from interior defined by the composite foundation wall 1 such as, but not limited to, a four-inch slotted corrugated plastic pipe 6. The drainage pipe may further be covered by a fabric sleeve to reduce the number of solids entering the pipe. Finally, the drainage pipe 6 may be covered with an aggregate 6A to collect water or other liquids within the crawl space to direct them into the drainage pipe 6. The aggregate 6A may be added to near the top of the footing. In some additional embodiments, the drainage system may be installed on an exterior side of the footing.

Figure 2:
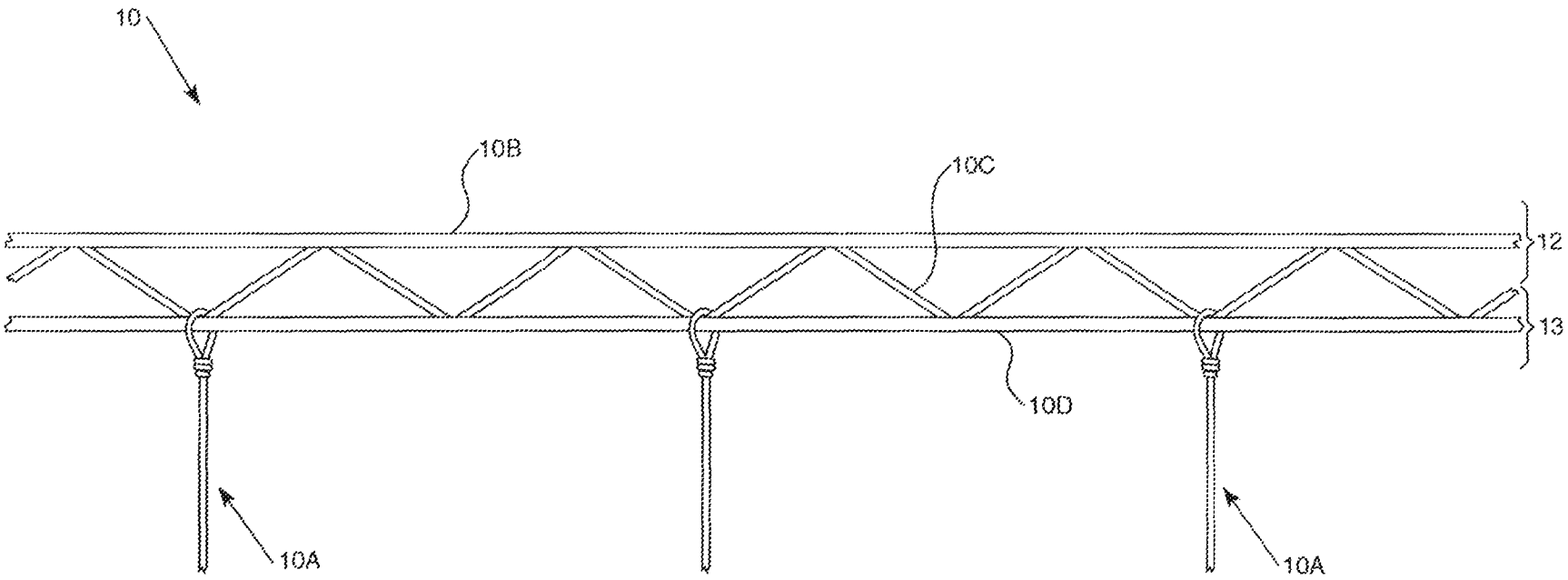
FIG. 2 depicts an embodiment of a truss shaped wall tie that may be incorporated into the composite foundation wall of FIG. 1.
Figure 2A:
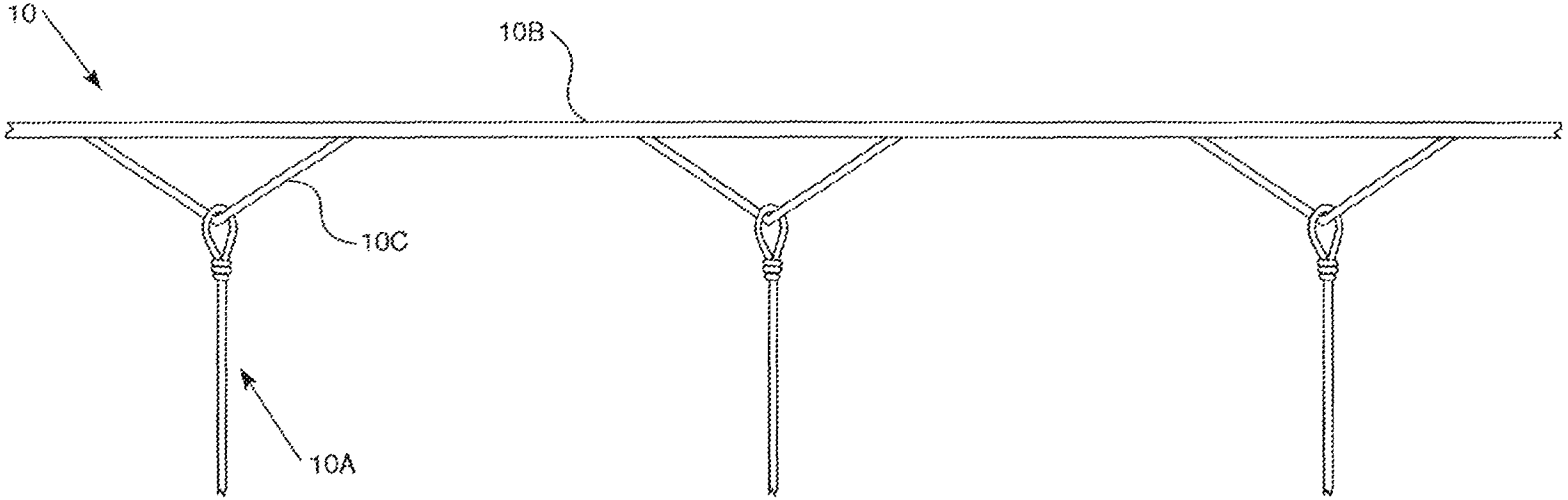
Figure 2B:
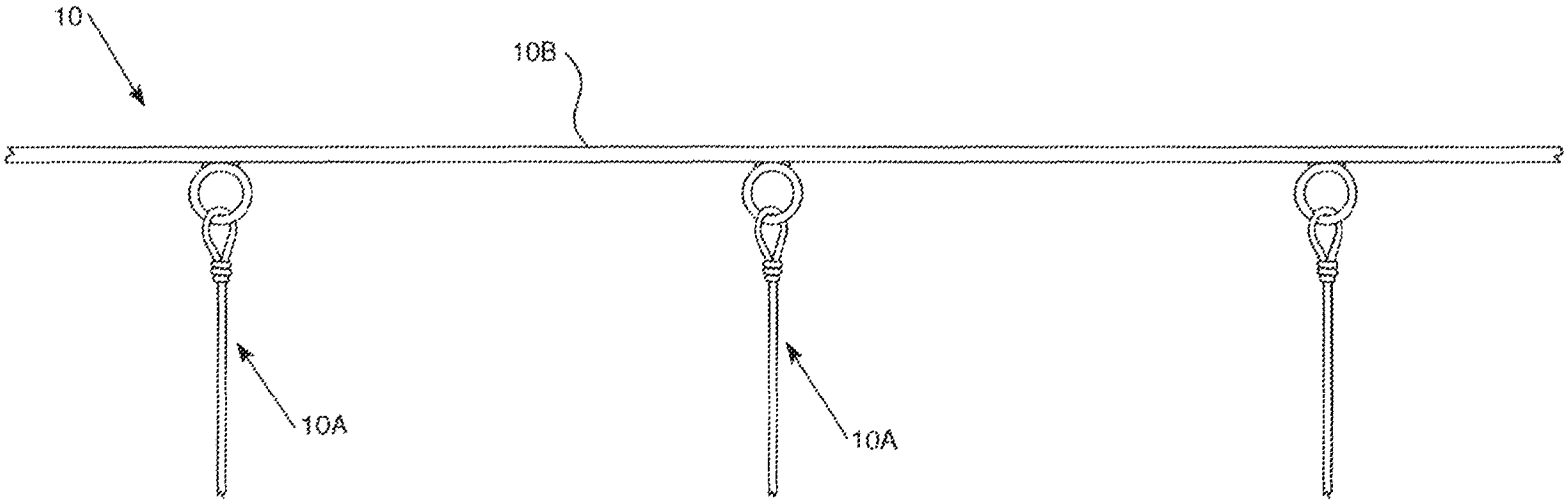
Figure 2C:
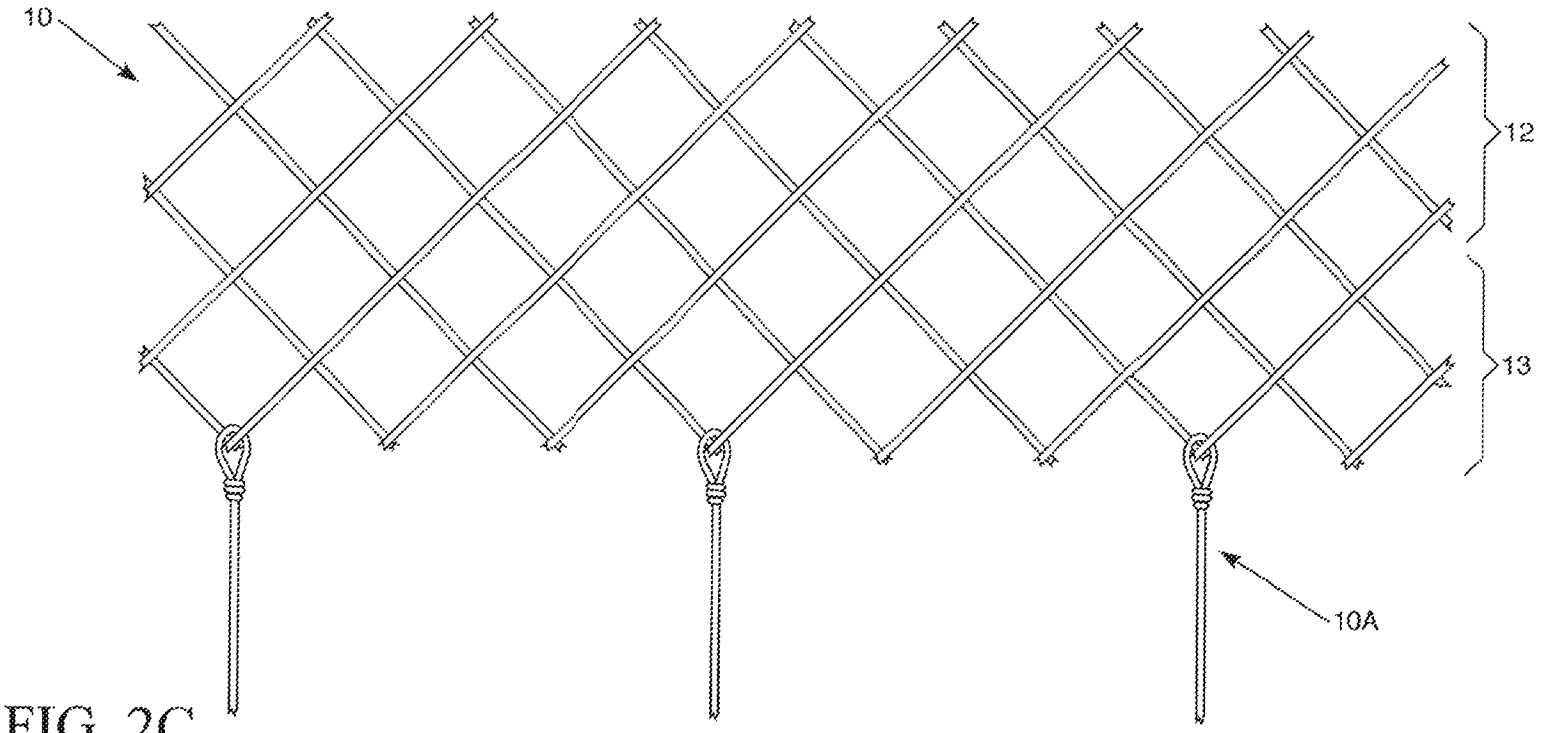
Figure 2D:
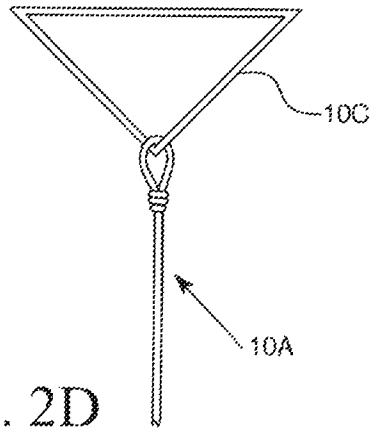

In the embodiment of the composite foundation wall shown in FIG. 1, the composite foundation wall 1 comprises wall ties. An embodiment of a wire tie 10 is shown in FIG. 2. The wall tie 10 comprises a CMU joint portion 12, a concrete core portion 13, and a wire tie 10A.

Figure 3:
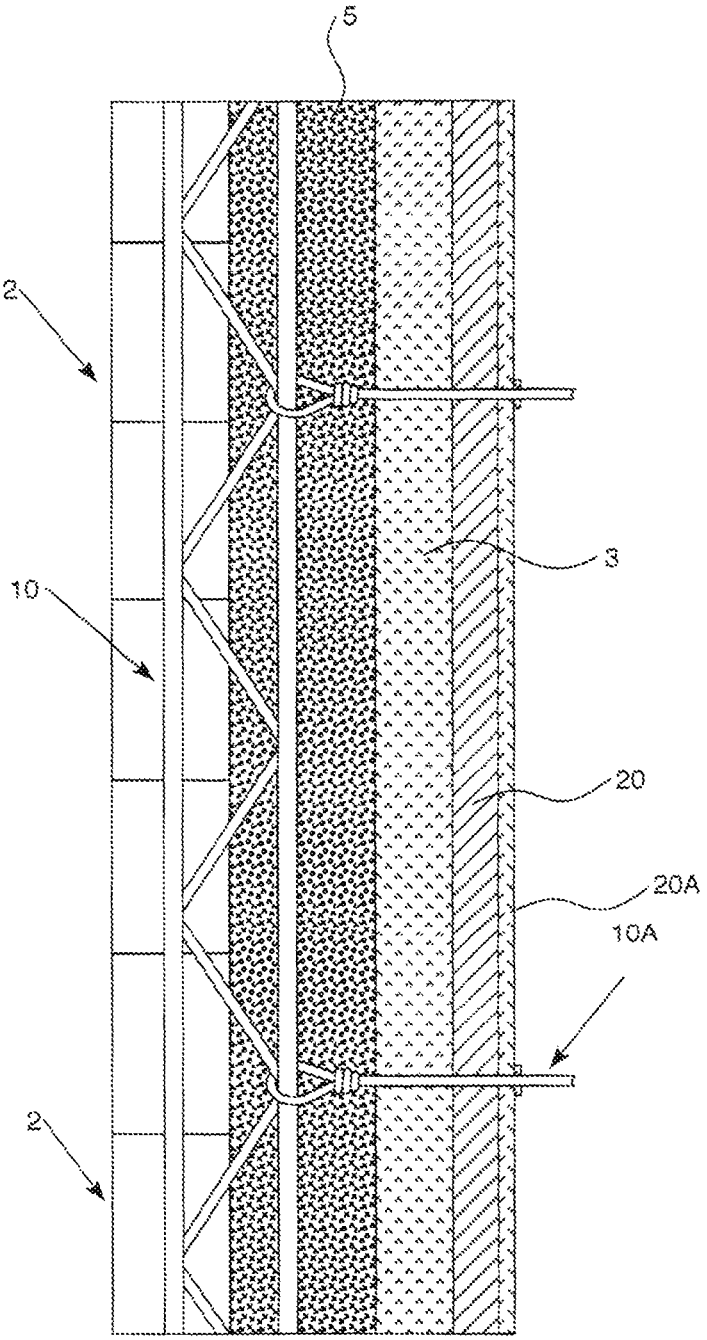
FIG. 3 depicts the wall tie of FIG. 2 placed on a course of bricks during construction of a composite foundation wall.

The wall tie 10 of FIG. 2 is shown incorporated into the composite foundation wall in FIG. 3. The wall tie 10 comprises a joint reinforcement rod or wire (hereinafter, "rod") 10B that is part of the CMU joint portion and is embedded in the bed joint of the CMU wythe 2. In the embodiment of the wall tie in FIG. 2, a truss shaped intermediate portion 10C connects the CMU joint portion 10A to the concrete core rod 10D. The wire ties 10A are connected to at least one of the intermediate portion 10C and the concrete core rod 10D. The wire tie 10A may be connected to at least one of the intermediate portion 10C and the concrete core rod 10D by any means. In the embodiment of the wall tie 10 in FIG. 2, the wire ties 10A are looped around the intermediate portion 10C and the concrete core rod 10D so that the wire tie 10A is rotatably fastened. If the wire tie 10A is rotatable, it may be easier to manipulate the wire tie 10A through the rigid panel and/or the wall form. The intermediate rods may be connected to the joint reinforcement rod 10B at an angle between 10° and 70° or, more narrowly, at an angle between 30° and 60°. In an embodiment of the wall tie wherein the wall tie consists essentially of the truss shaped intermediate member, the bend angles of the truss shaped rod may be between 10° and 140°.

In another embodiment of the wall tie 10, the wall tie 10 does not include a concrete core rod 10D but consists essentially of a joint reinforcement rod 108, a truss shaped intermediate portion 10C connected at a plurality of locations along the joint reinforcement rod 10B, and a wire tie 10A rotatably connected to a truss shaped intermediate portion 10C.

In a further embodiment, the truss shaped intermediate member 10C may not be a continuous truss shape but may be a series of bent rods forming a triangle with the joint reinforcement rod 10A. In such an embodiment, the intermediate triangles may be placed where a wire tie 10A is to be connected.

In still further embodiment of the wall tie 10, the wall tie 10 does not include a concrete core rod 10D or a joint reinforcement rod 10B but consists essentially of a truss shaped intermediate portion 10C and a wire tie 10A rotatably connected to a truss shaped intermediate portion 10C. In such an embodiment, a portion of the truss shaped intermediate portion 10C may be the CMU joint portion 12 and a second portion embedded in the concrete core may be the concrete core portion 13.

In still a further embodiment, the wall tie may not comprise a truss shaped intermediate portion but may comprise a series of intermediate rods that independently connected to the joint reinforcement rod 10B and extend to connect to at least one of the concrete core rod 100 and the wire tie 10A. In an embodiment, wherein the intermediate rods are at approximately a 90° angle to the joint reinforcement rod 10B, the wall tie is in a ladder shape. In embodiments of the ladder shaped wall tie the intermediate rods may be regularly spaced or irregularly spaced.

The composite foundation wall may comprise further attachments. The attachments may be used to attached components to the wall such as electrical boxes, decks, construction features such as construction features required by local building codes such as anchor bolts 7 and "Z" braces 8, for example.

Methods of Construction the Composite Foundation Wall

A typical project starts with the development of a site plan including a building size, foot print, style, and location on a lot. The building may be a commercial or residential building. From this site plan, a detailed footing and pier plan may be developed, if applicable, to support the building.

In many cases, the site plan must be approved, and subsequently a building permit is issued. Once the site plan is finalized, an engineer or surveyor will stake the corners of the footings, all piers interior to the footing, and all piers exterior to the footing so that the footing may be properly located and constructed.

An embodiment of the method of constructing a composite wall comprises excavating below grade for the footing for the residential or commercial building including the building, garage, piers, stoops and steps, for example. The excavation may be deep enough so that two to four courses of block or two courses to up to fifteen courses, for example, fifteen courses if the building has a basement, may be laid below the final grading of the building.

If necessary, the method comprises staking the corners of the footings, stoops, and the locations of all piers interior to the footing and all piers exterior to the footing so that the footing may be properly located and constructed.

The footing may then be constructed by either trenching for the footer or using forms to produce the footer. In one embodiment, the method comprises installing footing forms with rebar or other reinforcement. In some embodiments, the method may further comprise installing sleeves for any required wall penetration such as, water lines, electrical wiring, utility egress, sewer lines and gas lines, and drain tile or pipe under the footing from inside of crawl space to outside of crawl space.

In some instances, the footing forms and design will be inspected and, in such cases, once approved further construction can be performed. The method would comprise pouring concrete into the footing trenches or forms. After sufficient curing of the concrete, in embodiments that include footing forms, the method may include removing the footing forms from the footing. Typically, eight hours should be sufficient for curing the concrete prior to removing the forms.

Once the footing forms are stripped, an internal drainage system may be installed in the interior space of the footing. An example of an internal drainage system includes a slotted drain tile or pipe. The slotted drain tile or pipe may be covered in a plastic sleeve to reduce entry of solids. The slotted drain tile or pipe may be installed adjacent to the inside surface of the footing. This step may be easier with a formed footing as the base of the footing rests on the grade. A drain for the drain tile may be run through the sleeve form under or over the footing for the drain tile to the exterior to provide an effect water drain of the interior of the footing and/or crawl space to the exterior. In an event that the drain tile cannot be run to daylight on the exterior, a sump crock may be installed on the inside of the footing to install a sump pump which moves any water collected in the Interior of the footing/crawl space to an exterior location. The crawl space may be drained by a gravity fed drain pipe or a mechanical pumping device.

To improve drainage of the interior of the footing/crawl space stone may be installed on top of and next to the slotted drain tile or pipe around a significant portion or the entire inside perimeter of the footing. Further, in embodiments wherein the footing was constructed in a form, the interior of the footing may be back filled with dirt to produce a footing with a drained interior.

Now that the footing is complete, the engineer/surveyor may finalize the building location by setting brick points for all wall corners on footings, interior and exterior piers, and stoops, for example.

Now, construction of the composite foundation wall itself may begin on top of the footing. For composite foundation walls that will be completely or partially below grade, the composite wall may comprise concrete block for portions that are below grade or partially below grade and the wall may be continued by laying brick courses on the concrete block courses. In one embodiment, the method comprises providing and installing 4"×8"×16" CMU block/brick ("4" CMU block/brick") on the footing below grade over the length of the footing.

More specifically, the method of construction a composite foundation wall comprises laying a first course of 4-inch nominal or 8-inch nominal construction block in the below grade portions. Typically, at least the entire first course will be constructed by laying 4"CMU block/brick such as concrete block.

The method may further comprise installing wall ties with wire wall ties on top of the first course of CMU block/brick in mortar bed. For this construction, the wall ties will be positioned eight inches (8") above the top of the concrete footing. The wall ties, in this case, are placed in the bed joint on the first course of CMU and extend out of the bed joint toward the interior of the wall cavity. In one embodiment the wall ties are the truss shaped galvanized wire wall ties shown in FIG. 1. In an embodiment of the composite foundation wall using the truss-shaped galvanized wire wall ties in FIG. 1, the wall ties may be installed so that the truss shape portion extends from one inch to three inches from the face of the CMU into the interior of the footing/crawl space area. The wire tie may be extending 8" to the rear of the wall assembly into the interior of the footing/crawl space. The wire tie is long enough to extend through a rigid panel and, optionally, a wall form to secure the rigid panel at a spaced apart distance from the CMU wythe. The CMU wythe and the rigid panel will act as a form for pouring the concrete core. The wall tie may act as a joint reinforcement, a concrete reinforcement in the concrete core and to secure the rigid panel and/or the wall form with the wire tie, for example.

The CMU block/brick units are continued to be laid in courses. Wall ties may be places in each bed joint, in alternate bed joints, and there should be an effective number of wall ties with tie wires to support the rigid panel/wall form during pouring and forming of the concrete core. For 4" CMU block/brick using an alternating bed joint design for a composite foundation wall with a height of approximately 49⅝" to 120" basement from the top of the footing, the wall ties will be installed in the bed joints 8" above footing, 24" above footing and 40" above footing. In such an embodiment, the method of constructing the composite foundation wall comprises laying a second course and third course of construction block or equivalent height of brick in a bed joint on top of the first course, on top of the third course and on top of the fifth course in the bed joints. A portion of the joint reinforcement is within the bed joint and the wire tie is on an inner side of the wall.

In some embodiments, the wall ties may be fabricated on site either prior to being installed in the mortar joints or after installing as joint reinforcement in the bed joint. Fabricating the wall ties may comprise attaching wire ties to the joint reinforcement.

In a specific embodiment, the wall ties may be installed on the 1st course of 4" CMU block and then 16" on center horizontally. The wire ties may be installed vertically along the wall tie. The wall ties may be installed in an effective amount to support the rigid panel and/or the wall form sufficiently to hold the rigid panel and/or the wall form to form the concrete core by pouring concrete between the CMU wythe and the rigid panel. In one embodiment, the wire ties may be installed along the joint reinforcement spaced at a distance from 12 inches to 24 inches. The wire ties may be placed at the same spacing on each course.

However, in another embodiment, the method comprises installing the wire ties to the joint reinforcement at a greater distance between wire ties for the joint reinforcement above the wire tie on the first course. For example, the wire ties may be installed on the joint reinforcement at intervals between 24 inches to 40 inches on center for the second joint reinforcement on the top of the third course of CMU block/brick. Each subsequent joint reinforcement may include wire ties spaced between 12 inches and 40 inches or spaced between 24 inches and 40 inches, for example.

Once the 4" CMU block/brick wythe is installed up to the desired height such as a height of 49⅝", for example, above the footing, the rigid panel and/or the wall form is installed spaced apart from the CMU wythe. In one embodiment, the rigid panel may be a rigid board insulation, for example a two-inch rigid insulation panel (typically a 25 psi panel), may be installed. The distance that the rigid panel is installed from the CMU wythe will create a cavity to pour concrete into to produce the concrete core. The distance may be any distance to create sufficient strength in the concrete core. For example, the distance may be between 1 inch and 8 inches. In another embodiment, the distance may be between 2 inches and 5 inches. In one exemplary composite wall the concrete core is approximately 4" thick behind the back side of the brick and block wall creating a 4" core. In one embodiment, the rigid panel should be supported in a substantially parallel position to the CMU wythe to form the core cavity.

In one embodiment, the rigid panel has grooves on the surface. The grooves may fill with concrete to adhere the rigid panel to the concrete core. For example, the rigid board insulation (25 psi typical) is scored on the front side (cavity side) of the form so the concrete will adhere to the board in the wall assembly. In another embodiment, the rigid panel may be formed with the scoring prior to installation or grooves at the time of production. In a preferred embodiment, the rigid panel comprises grooves spaces apart between 14 and 18 inches apart. In another embodiment, the rigid panel comprises grooves that are located approximately 8-inches (6 inches to 10 inches); approximately 24 inches (22 inches to 26 inches); and 40 inches (38 inches to 42 inches) above the bottom surface of the rigid panel.

Therefore, an embodiment of the method comprises threading the wire ties through or attached to the rigid panel. In one embodiment, the method comprises inserting the wire ties through apertures defined in the rigid panel to support the rigid panel in position.

Figure 4:
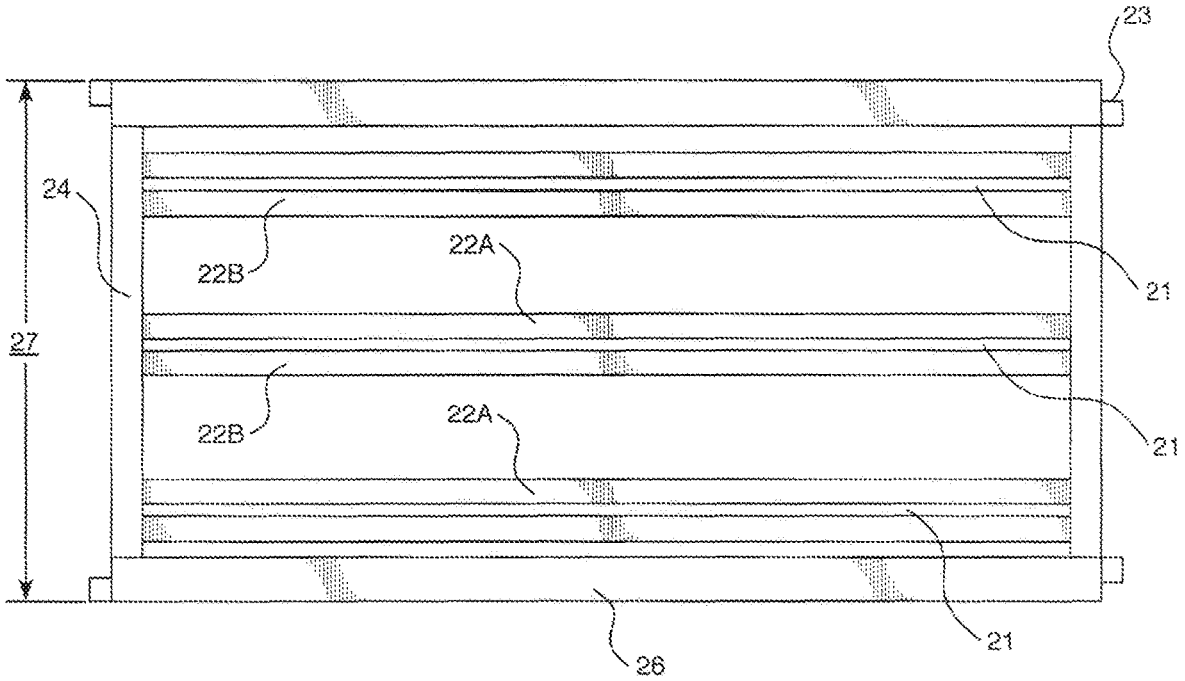
FIG. 4 depicts an embodiment of the wall form having cross bars defining slots for receiving wire ties to support the wall form.
Figure 5:
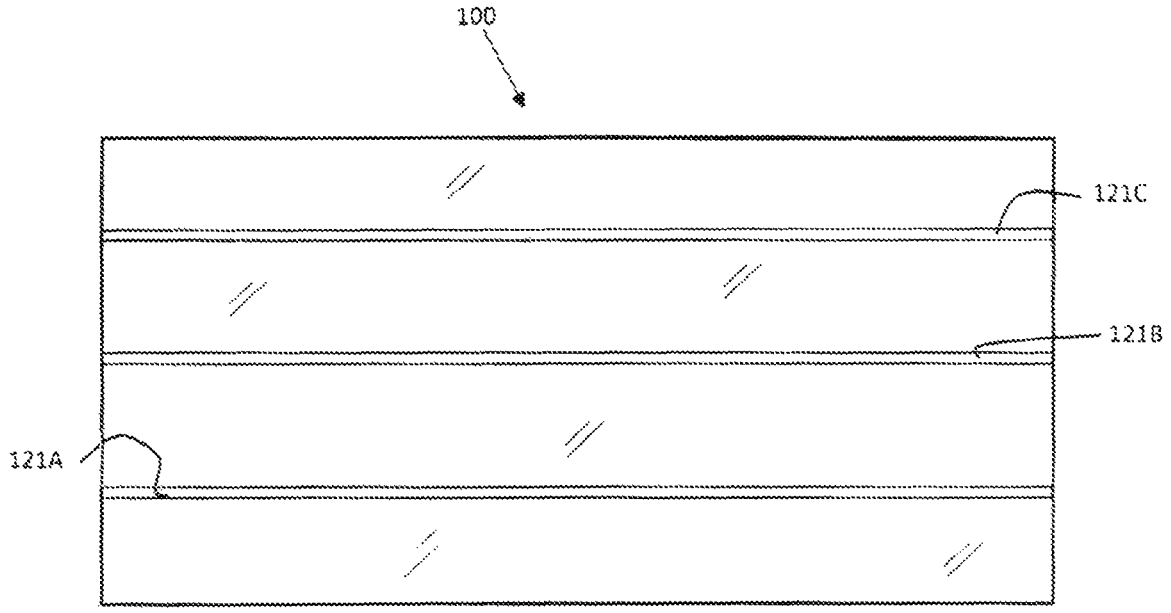
FIG. 5 depicts an embodiment of the rigid foam insulation panel 100 comprising a groove 121A, a second groove 1218, and a third groove 121C.

In embodiments comprising a wall form, the method comprises inserting the wire ties through the form after threading the wire tie through the rigid panel. The wall form 20 may be an aluminum wall form as shown in FIG. 1 and FIG. 4. In other embodiments, the wire tie may be threaded through a wall form support device. The wall form support device may be any member that further supports in a parallel position. The support device may be flat metal bars, such as one quarter inch flat metal bars. The flat metal bars may be installed vertically behind the wall form at the location of the wall ties.

The wire tie is pulled through the vertical bar and a sleeve is swaged on the wire tight to the back side of the vertical metal bar thus securing the wall form to the rigid board insulation (25 psi typical) and the masonry wall together creating a concrete core cavity between the front side of the rigid board insulation and back side of the masonry wall. The masonry wall portion of the assembly typically requires 24 hours from completion for the mortar joints of the CMU block/brick to cure The wall form 20 may be installed behind the rigid board insulation by pulling the wire ties through an aperture or groove defined in the wall form and fastening the wire tie tightly against the wall form to support the wall form and the rigid sheet material in a fixed position relative to the CMU masonry wall. The wall tie may extend the length of the joint reinforcement to be between 8" and 12" long (approx.) from the back edge (inside surface) of the CMU wythe.

Optionally, the wall form support members may be installed vertically across the horizontal beams of the wall form to further support the wall form 20 and prevent distortion.

In one embodiment of the method, the wall form may need further support to support the rigid panel during pouring of the concrete into the core cavity. In such embodiments, the method may comprise installing a support member on the footing at the bottom of the wall form. For example, once the Installation & tying of the rigid panel or the rigid board insulation and/or the wall form is completed, a bracket may be connected to the top of the footing to prevent movement of the wall form as the concrete is being poured. The bracket may be connected to the footing and bottom rail of the wall form on the crawl space side of the wall form, for example. The bracket may be a metal Z bar, an L-shaped bracket, a stop or other bracing member that prevents movement of the bottom of the wall form at least in the direction into the crawl space/inner space.

Once the wall assembly (including the CMU wythe including the wall ties and the rigid panel and, optionally, a wall form with its support members) is complete and masonry components have sufficiently cured (for example, cured for approximately 24 hours) then concrete is poured into the cavity. The concrete may be poured from a concrete mixer such as a truck or a concrete mixer with the aid of a concrete mixer attachment that is attached to a track driven piece of equipment. As the cavity is being filled with concrete, the concrete may be vibrated in place to ensure no voids.

Once the concrete is poured into the cavity and the concrete cures, the wall ties extending through at least one of the rigid panels, the wall form and the wall form support members may be cut off with wire cutters from the back side of the wall form. Embodiments of the method may then comprise removing the aluminum wall form. The wire ties may simple by cut with wire cutters, for example.

Any further exposed wire protruding from the back of the rigid board insulation or other rigid panel may be cut off flush with the back of the rigid board insulation or other rigid panel.

Finally, the dirt excavated to form the footings may be graded on the exterior of the composite foundation wall to establish positive drainage on the entire perimeter of the foundation wall per the Building Code.

Wall Form

An embodiment of a wall form 20 may be used to support the rigid panel 3 as part of the form for pouring the concrete core or may be the complete form for use in an embodiment of the composite wall that does not comprise of a rigid panel. In embodiments of the method of forming a composite wall, the wire ties of the wall tie are threaded through apertures or slots 21 in the wall form 20. The wire ties 10A may be threaded through the slot 21 and fastened to retain the wall form 20 in the substantially correct position to form the concrete core 5. The slots of the wall form generally correspond to joints in the CMU wythe. The slots may preferably be horizontal or vertical to make threading the wire ties through the wall form easier. The slots 21 may be across the entire inner width of the wall form or may be intermittent across the inner width. The inner width is defined as the width between the two upright end panels 24. The slots 21 are defined by a gap between an upper bar 22A and lower bar 22B. The gap may be any size to accommodate the wire tie and a lock to secure the wire tie from sliding back through the slot.

The wall form 20 may be constructed of any height 27 appropriate for the composite foundation wall to be constructed. For the composite foundation wall of FIG. 1, the wall form may be 50 inches tall, for example.

The slots 21 of the embodiment of the wall form of FIG. 4 correspond to bed joints in the composite wall of FIG. 1. Therefore, the gaps are approximately 8-inches (6 inches to 10 inches); approximately 24 inches (22 inches to 26 inches); and 40 inches (38 inches to 42 inches) above the bottom surface 26 of the wall form. These gaps conform to the mortar joints of an 8-inch CMU wythe with wall ties on top of the first, third and fifth courses. The location of the bars and the gaps may be any location to correspond to the wire tie locations of the mortar joints of the CMU wythe. The wall form may have more than three gaps. In another embodiment, the slots or apertures may correspond to every mortar joint.

Another embodiment of the wall form may comprise a complete sheet with slots defined in the sheet instead of defined by two parallel bars.

In still another embodiment, the wall form may comprise additional bars. The additional bars may be substantially perpendicular to the slots to provide additional support to the bars defining the gaps. The additional bars may be permanently connected to the wall form such as by welding, adhesives, screws or other permanent connectors or may removably connected such as by securing both the wall form and additional bars with the wire ties. A permanent connection is one where the additional bars do not separate from the wall form when the wire ties are cut after forming the inner core.

The embodiments of the described methods and the composite foundation wall are not limited to the embodiments, components, method steps, and materials disclosed herein as such components, process steps, and materials may vary. Moreover, the terminology employed herein is used to describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be affected within the scope of the invention as defined in the appended claims. Accordingly, the scope of the various embodiments of the present invention should not be limited to the above discussed embodiments and should only be defined by the following claims and all equivalents.

The invention claimed is:

1. A composite wall structure, comprising:

a footing, wherein the footing comprises an upper surface;

a wythe defining an exterior side of the wall structure comprising at least one course of a concrete masonry unit laid on the upper surface, wherein the course of concrete masonry unit has an inner surface and an exterior surface;

a concrete core adhered to the inner surface of the concrete blocks;

a rigid panel adhered to an inner surface of the concrete core; and a wall tie extending from a joint within the wythe through the concrete core;

wherein the wall tie comprises a rotatable wire tie, wherein the wire tie is looped around and fastened to rotatably attach the wire tie to the wall tie, and wherein the wire tie extends from the concrete core through the rigid panel.

2. The composite wall structure of claim 1, wherein the footing is a concrete footing.

3. The composite wall structure of claim 2, wherein the wythe comprising at least one course of a concrete masonry unit is a course of concrete block.

4. The composite wall structure of claim 3, wherein the concrete block is nominal 4 inch×8 inch×16 inch concrete block.

5. The composite wall structure of claim 3, wherein the concrete block is nominal 4 inch in depth.

6. The composite wall structure of claim 5, comprising at least one course of exterior masonry face material laid on the at least one course of concrete blocks.

7. The composite wall structure of claim 6, wherein the exterior masonry face material is brick.

8. The composite wall structure of claim 7, wherein the concrete core is adhered to an inner surface of the brick, wherein the concrete core extends into texture features of the brick, joints between the brick, or combinations thereof.

9. The composite wall structure of claim 1, wherein the concrete core is adhered to an inner surface of the concrete masonry unit, wherein the concrete core extends into texture features of the concrete masonry units, joints between the concrete masonry units or combinations thereof.

10. The composite wall structure of claim 1, wherein the rigid panel is a fiberglass insulation foam board.

11. The composite wall structure of claim 10, wherein the rigid panel has grooves and the concrete core extends into the grooves.

12. The composite wall structure of claim 1, wherein the rigid panel is plywood.

13. The composite wall structure of claim 1, wherein the rigid panel is at least one of a fiber board, dry wall panel, a brick panel, and a stone panel.

14. The composite wall structure of claim 1, wherein the wall tie extending from a joint within the exterior wall portion through the concrete core comprises:

a joint reinforcement rod;

a concrete reinforcing rod, wherein the concrete reinforcing wire is spaced apart from the joint reinforcing wire and is embedded in the concrete core;

a plurality of intermediate rods; wherein the intermediate rods hold the joint reinforcement rod and the concrete reinforcing rod in a substantially parallel position.

15. The composite wall structure of claim 14, wherein the rigid panel is a rigid foam insulation board, comprising:

a panel constructed of rigid foam;

a back surface of the panel; and at least one groove defined in the rigid foam in the back surface.

16. The composite wall structure of claim 15, wherein one of the at least one groove is between 7 inches and 9 inches from the bottom edge.

17. The composite wall structure of claim 16, wherein the rigid foam is a closed cell rigid foam.

18. The composite wall structure of claim 16, wherein the rigid foam insulation board comprises a second groove defined in the rigid foam, wherein the second groove is between 23 and 25 inches from the bottom surface.

19. The composite wall structure of claim 18, wherein the rigid foam insulation board comprises a third groove defined in the rigid foam, wherein the third groove is between 39 and 41 inches from the bottom surface.

20. The composite wall structure of claim 15, wherein one of the at least one groove is 8 inches from the bottom edge.

21. The composite wall structure of claim 15, wherein the rigid foam insulation board comprises a second groove defined in the rigid foam, wherein the second groove is parallel to the first groove and spaced between 15 to 17 inches laterally from the first groove.

22. The composite wall structure of claim 21, wherein the rigid foam insulation board comprises a third groove defined in the rigid foam, wherein the third groove is parallel to the second groove and spaced between 15 to 17 inches laterally from the second groove.

* * * * *